US007296964B2

(12) United States Patent
Montgomery

(10) Patent No.: US 7,296,964 B2
(45) Date of Patent: Nov. 20, 2007

(54) APPARATUS AND METHODS FOR MINIMIZING SOLID PARTICLE EROSION IN STEAM TURBINES

(75) Inventor: Michael Earl Montgomery, Niskayuna, NY (US)

(73) Assignee: General Electric Company, Schenectady, NY (US)

( * ) Notice: Subject to any disclaimer, the term of this patent is extended or adjusted under 35 U.S.C. 154(b) by 87 days.

(21) Appl. No.: 11/235,124

(22) Filed: Sep. 27, 2005

(65) Prior Publication Data

US 2007/0071594 A1 Mar. 29, 2007

(51) Int. Cl.
*F01D 25/26* (2006.01)

(52) U.S. Cl. ..... 415/108; 415/144

(58) Field of Classification Search ..... 415/115, 415/116, 108, 144

See application file for complete search history.

(56) References Cited

U.S. PATENT DOCUMENTS

| | | | |
|---|---|---|---|
| 4,615,734 | A | 10/1986 | Spriggs |
| 4,704,336 | A | 11/1987 | Spriggs |
| 4,776,765 | A | 10/1988 | Sumner et al. |
| 4,853,014 | A | 8/1989 | Bloch |
| 4,921,546 | A | 5/1990 | Bloch |
| 4,922,937 | A | 5/1990 | Bloch |
| 4,986,309 | A | 1/1991 | Bellanca |
| 5,249,918 | A | 10/1993 | Knorowski |
| 5,295,301 | A | 3/1994 | Knorowski |
| 5,363,603 | A | 11/1994 | Miller et al. |
| 6,288,000 | B1 | 9/2001 | Hebsur |
| 6,391,811 | B1 | 5/2002 | Hebsur |
| 6,605,648 | B1 | 8/2003 | Johnson et al. |
| 6,644,917 | B2 | 11/2003 | Zhao et al. |
| 6,679,681 | B2 | 1/2004 | Burnett et al. |
| 2003/0194312 | A1 | 10/2003 | Burnett et al. |

FOREIGN PATENT DOCUMENTS

| | | | |
|---|---|---|---|
| CA | 1273538 | A1 | 9/1990 |
| JP | 61031602 | A * | 2/1986 |
| JP | 0524806 | A2 | 9/1993 |
| KR | 9207849 | B1 | 9/1992 |

* cited by examiner

*Primary Examiner*—Edward K. Look
*Assistant Examiner*—Dwayne J White
(74) *Attorney, Agent, or Firm*—Nixon & Vanderhye, PC

(57) ABSTRACT

Solid particle erosion in a steam turbine is minimized by diverting through holes in appendages of outer rings of the diaphragms, a portion of the steam from the steam flow path thereby bypassing downstream rotating components. The hole through the first stage appendage lies in communication with a passage through a downstream outer ring of a following stage such that the diverted solid particle containing steam may be extracted from the steam flow path and passed to the feed water heater of the turbine. The hole in the second stage appendage diverts steam from between the first and second stages and about the second stage. Solid particle erosion in various regions, i.e., the trailing edge of the stator vanes, along the surfaces of the buckets and in the regions of the cover and its connection with the buckets as well as the sealing devices are thereby minimized.

12 Claims, 5 Drawing Sheets

APPARATUS AND METHODS FOR MINIMIZING SOLID PARTICLE EROSION IN STEAM TURBINES

The present invention relates to apparatus and methods for minimizing solid particle erosion in steam turbine components and particularly relates to apparatus and methods for removing solid particles from the steam flow path to minimize damage to the turbine components.

BACKGROUND OF THE INVENTION

Solid particle erosion of the components of a steam turbine occurs due to carryover of particles from the steam boiler and piping upstream of the turbine. The solid particles become entrained in the steam flow path. As they pass through the steam turbine, the particles cause damage to both the stationary and rotating parts of the turbine that degrade steam turbine performance and mechanical reliability. The solid particles may be deposited throughout the steam path or may exit the steam path into steam extractions that feed the feed water heaters of the cycle. However, since the particles are transported by the main steam flow through the steam turbine steam path, they have the opportunity to inflict considerable damage to the steam path before they are deposited or expelled from the main steam flow. This damage can include erosion of the rotating and stationary buckets and partitions respectively, erosion of the rotating tip covers or tenons, erosion of tip sealing devices such as spill strips and erosion of stationary structures over the tips of the rotating buckets.

Various apparatus and methods have been proposed and utilized to minimize the impact of the solid particles on the rotating and stationary parts of steam turbines. For example, in U.S. Pat. No. 4,776,765 a protective device is disposed over a portion of the suction side of the partition to prevent solid particle erosion of the trailing edge of the partition due to rebound of particles from the leading edge of the buckets. Other apparatus and methods for minimizing or eliminating solid particle erosion in steam turbines include solid particle erosion resistant coatings such as disclosed in U.S. Pat. Nos. 4,704,336 and 4,615,734. While many of these and other efforts to minimize or eliminate solid particle erosion have been tried in the past, solid particle erosion in steam turbines remains a continuing problem for the various parts along the steam path. Accordingly there has developed a further need for apparatus and methods to minimize solid particle erosion of steam turbine components.

BRIEF DESCRIPTION OF THE INVENTION

In a preferred embodiment of the present invention there is provided a steam turbine comprising: a stage of the steam turbine including a diaphragm having an inner web, an outer ring and a plurality of stator vanes therebetween; the outer ring having an axially downstream appendage overlying tips of buckets forming part of the turbine stage; and at least one hole through the appendage for diverting a portion of the steam in a steam flow path upstream of the buckets of the turbine stage and bypassing the buckets of the turbine stage.

In a further preferred embodiment of the present invention there is provided a method of minimizing solid particle erosion in a steam turbine stage comprising the step of diverting a portion of the steam in a steam flow path through a hole in an appendage of an outer ring overlying bucket tips of the turbine stage and bypassing the buckets of the turbine stage.

DETAILED DESCRIPTION OF THE INVENTION

Figure 1:
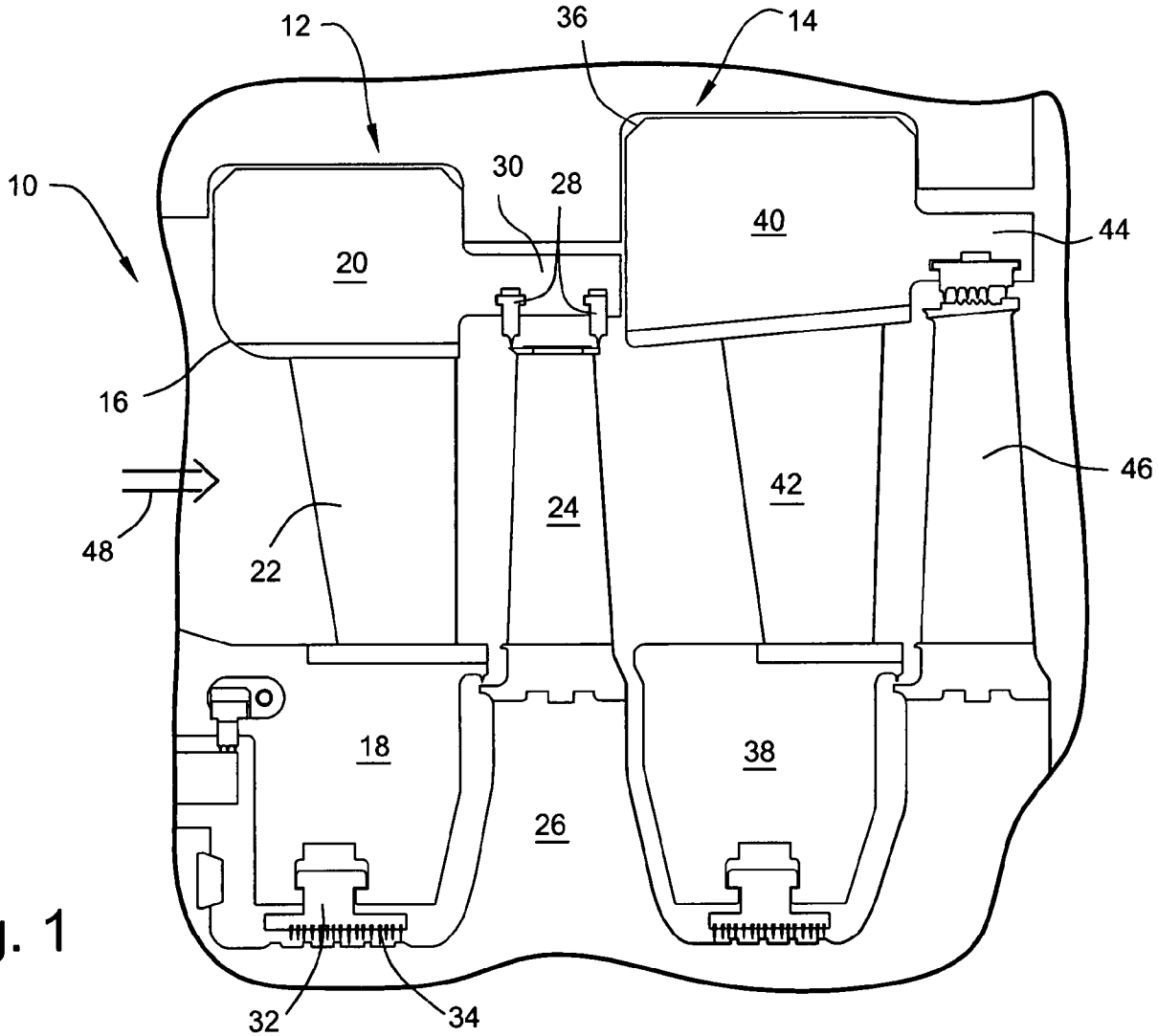
FIG. 1 is a schematic illustration of a typical stage geometry of and function for a steam turbine.

Referring now to FIG. 1, there is illustrated typical steam turbine stages of a steam turbine generally designated 10. Two stages of the steam turbine 10 are illustrated, for example, a first stage generally designated 12 and a second stage generally designated 14. The first stage 12 includes a diaphragm 16 having an inner web 18, an outer ring 20, and a plurality of circumferentially spaced stator vanes or partitions 22 therebetween. The first stage also includes buckets 24 secured to a rotor 26. The tips of the buckets 24 rotate past sealing devices 28 formed on an axially extending appendage 30 of the outer ring 20. The inner web 18 of the first stage diaphragm includes sealing segments 32, in this instance, mounting labyrinth seal teeth 34 for sealing about the rotor 26. The second stage 14 is similar and includes a diaphragm 36, an inner web 38, an outer ring 40, partitions 42 circumferentially spaced one from the other and disposed between the inner web and outer ring, the outer ring 40 having an appendage 44 overlying tips of buckets 46 mounted on the rotor 26. It will be appreciated that the steam flows through the illustrated stages in the direction of the arrow 48 rotating the rotor 26, enabling useful work to be derived from the steam turbine 10.

Figure 2:
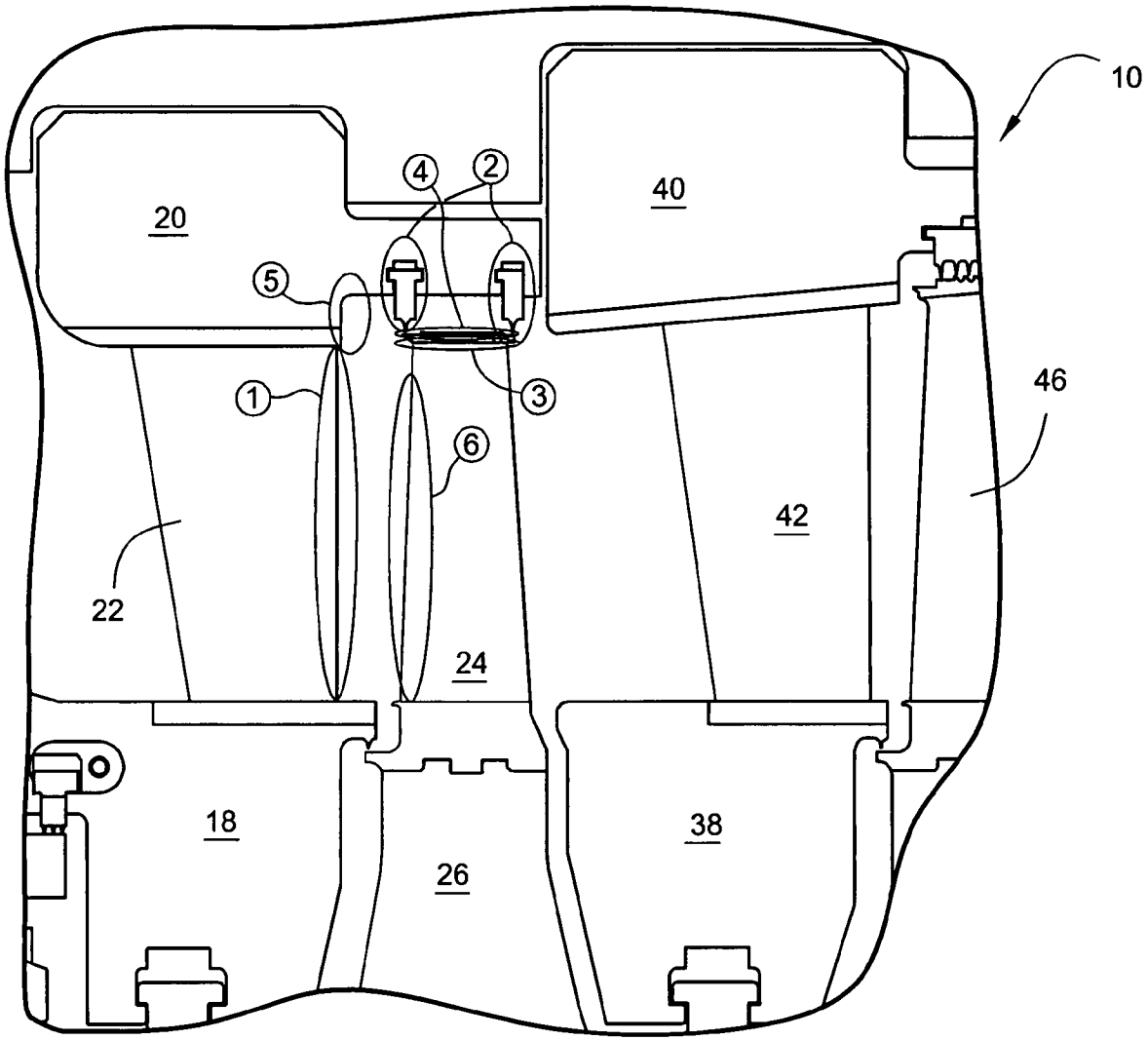
FIG. 2 is a view similar to FIG. 1 with areas denoted by the numbered ovals indicating typical damage caused by solid particle erosion in the turbine.

As noted previously, solid particles flowing in the steam path tend to erode the various components of the turbine with consequent degradation in performance and efficiency. The region denoted ① in FIG. 2 constitutes the trailing edge of the partitions. Solid particle erosion in region ① can seriously effect the mechanical integrity of the stationary vanes, potentially impact the mechanical integrity of the rotating vanes due to forced response phenomena and degrades stage performance due to the increase in stationary vane area, throat shape and flow angle degradation. Region ② in FIG. 2 denotes an area of increased tip leakage of steam due to solid particle erosion to the tip sealing devices, e.g., devices 28. Region ③ in FIG. 2 denotes areas where solid particles are deposited by centrifugal action under the covers of the rotating buckets. Such deposits can degrade mechanical integrity of the rotating buckets by changing the response of the rotating structure. They may also degrade performance by blockage of the rotating steam path near the tip. Region ④ in FIG. 2 denotes solid particle erosion in the area of the connection between the tenons and covers which can seriously effect the mechanical integrity of the covers and tenons at their connections. For example, over extended periods of time and being subject to solid particle erosion, the tenon or cover or both can be eroded to the extent that their mechanical integrity is degraded such that mechanical failure may occur. Also, cover and tenon erosion combined with tip sealing device erosion in region ③ can decrease stage performance and efficiency due to increased tip leakage. In region ⑤ of FIG. 2, solid particle erosion causes damage to the typical outer ring cutback region which can effect the mechanical integrity of the tip sealing device retention. Solid particle erosion can also cause damage to the bucket surfaces per se as denoted in region ⑥ in FIG. 2. This can degrade stage performance due to increases in rotating vane surface roughness. From the foregoing, it will be appreciated that solid particle erosion may significantly damage the performance and efficiency of the steam turbine and seriously affect part life.

Figure 3:
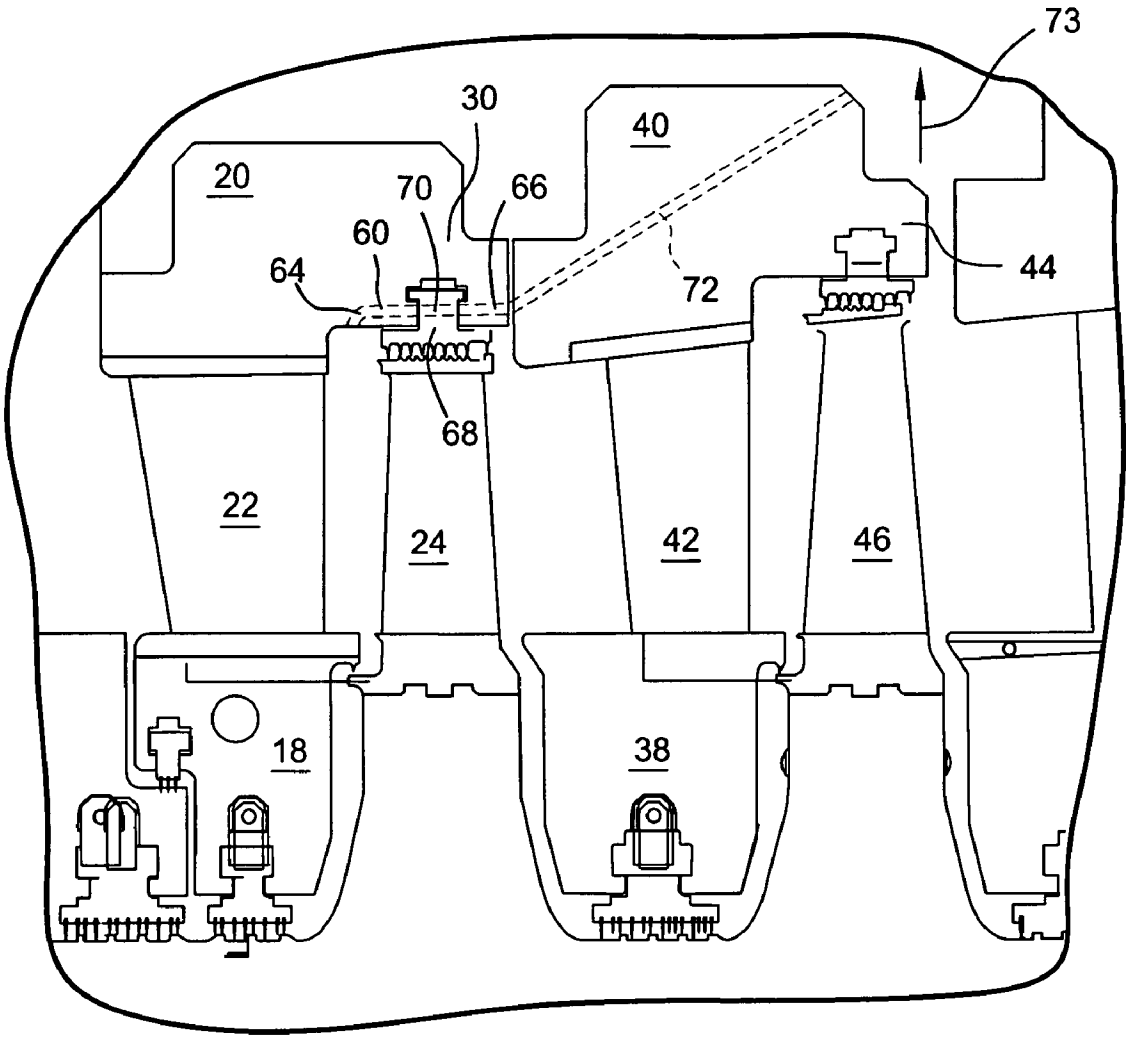
FIG. 3 is a view similar to FIG. 1 illustrating devices for diverting solid particles in the steam path in accordance with a preferred aspect of the present invention.

Referring to FIG. 3, wherein like reference numerals are applied to like parts as in the conventional steam turbine construction illustrated in FIG. 1, the present invention provides for the removal of a portion of the solid particles from the main steam flow so as to minimize damage to downstream steam path components. Another function is to minimize erosion damage to the tip sealing device retention. Generally, holes and passageways are provided in the component parts to divert a portion of the steam and hence the solid particles carried by the steam about the rotating parts. As used herein, the term "passageway(s)" or "passage(s)", embraces slots, grooves, openings and the like for performing the function of diverting a portion of the steam and solid particles about the rotating parts. Thus, passages are provided through the outer ring of the first stage to bypass a portion of the steam about the first stage buckets and sealing devices. The diverted steam also flows through a passageway in a downstream stage, bypassing the stationary and rotating parts of the downstream stage. Another set of holes and passages are provided in the downstream stage such that residual solid particles in the steam are able to bypass the downstream stage rotating parts. The diverted steam portions are then discharged from the steam path to the extraction or heater.

Figure 4:
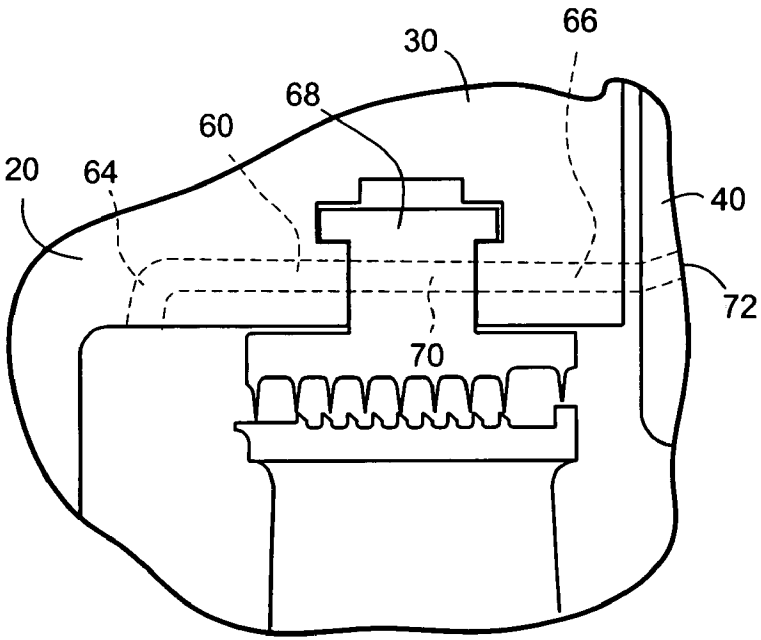
FIG. 4 is an enlarged fragmentary schematic illustration of a diaphragm appendage, e.g., a first stage diaphragm appendage and sealing device illustrating a diverted portion of the steam flow.

More particularly, and referring to FIGS. 3 and 4, an aspect of the present invention provides one or more holes 60 in the appendage 30 for diverting a portion of the steam flowing through the steam path through the hole 60. It will be appreciated that the appendage 30 may be integral with or a separate part affixed to the ring 20. The hole 60 includes an inlet opening 64 upstream of the buckets 24 of the stage, e.g., the first stage. The hole 60 is divided into two portions 64 and 66 on opposite sides of the sealing device 68. The sealing device may comprise a spring or steam biased sealing segment carrying labyrinth seal teeth for sealing about the tip of the rotating buckets 24. Thus, a passage 70 extends through the sealing segment 68 in communication with the hole portions 64 and 66, thereby constituting a through passageway in appendage 30 for bypassing steam about the rotating parts, i.e., the buckets 24 of the stage. As illustrated, the hole portion 66 exits into a passageway 72 extending through the outer ring 40 of the next, e.g., second stage. The passage 72 exits to a steam extraction passage indicated by the arrow 73 to a feed water heater or other external connection, not shown, to which the solid particles will be expelled. It will be appreciated that the drawing FIGS. 3-5 as well as FIG. 6, by standard convention, are inverted such that the holes, passages and passageways are located in the bottom of the steam turbine to facilitate concentration of the solid particles and their removal and diversion from the steam path and about the rotating parts.

Figure 5:
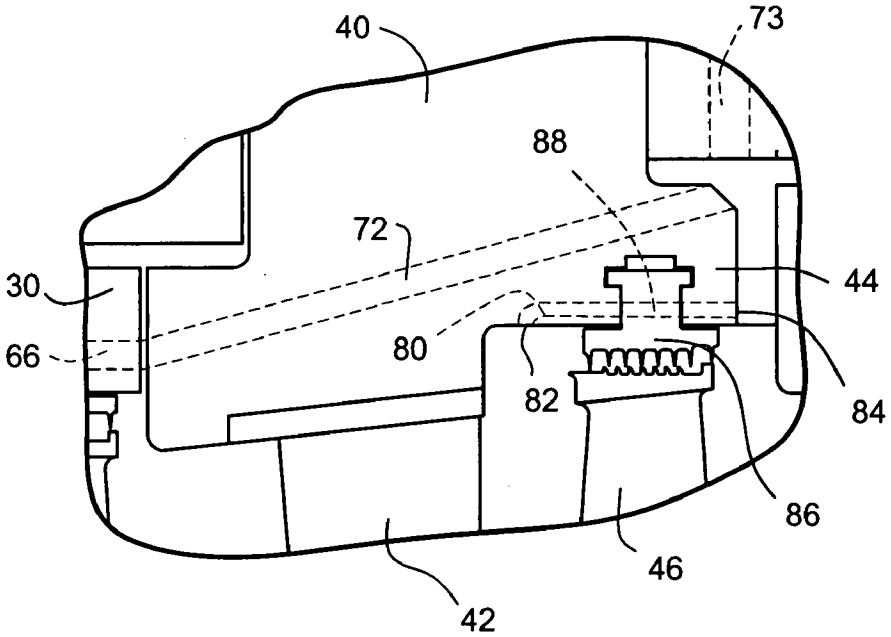
FIG. 5 is a fragmentary schematic illustration of a second stage of a steam turbine illustrating the diverted steam portions from the first and second stages.
Figure 6:
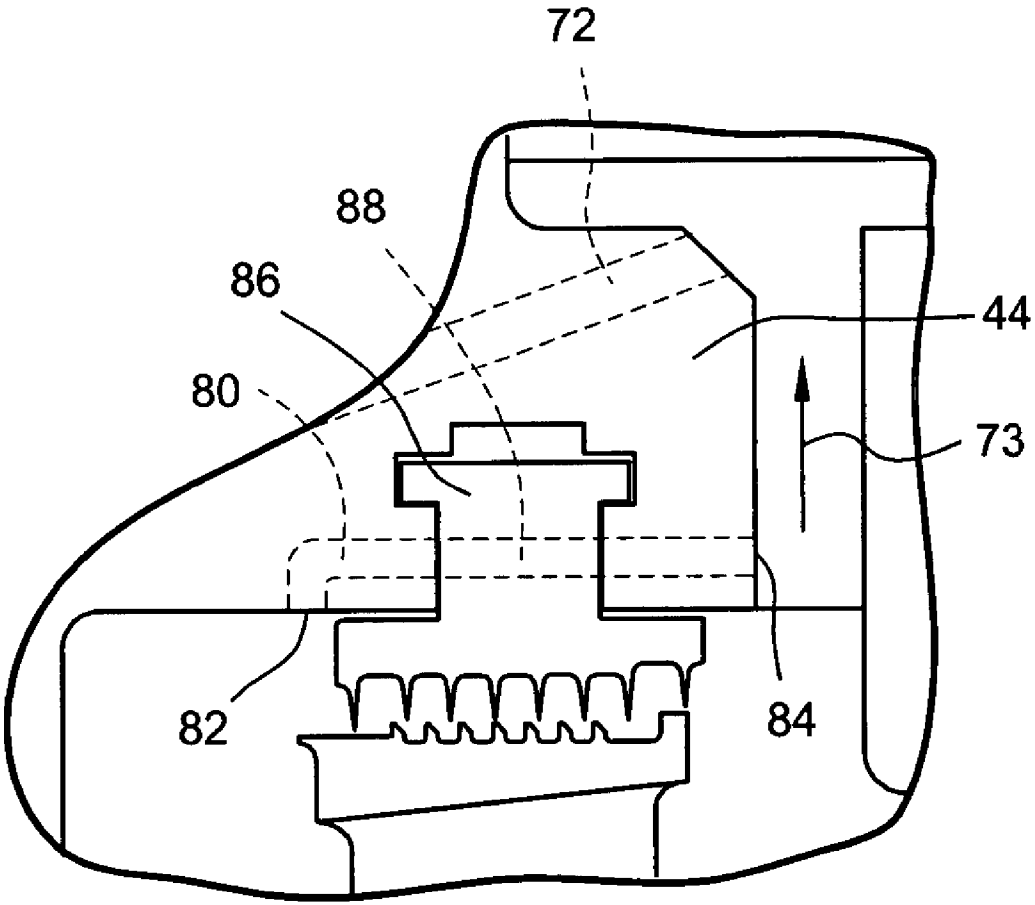
FIG. 6 is an enlarged schematic illustration of a diaphragm appendage of a second stage of the steam turbine showing the exit path of the diverted steam.

Referring to FIGS. 5 and 6, a similar arrangement for the downstream, e.g., second stage of the steam turbine is provided for diverting solid particles in the steam flow path about the rotating part of the second stage 14. Specifically, the appendage 44 of the downstream, e.g., second stage, includes a hole 80 having an entrance aperture 82 and an exit aperture 84. Similarly, as in the first stage diversion, the sealing device 86 in the downstream stage includes a passage, i.e., a hole 88 in communication with the hole 80 whereby residual solid particle containing steam in the steam path may flow into the entrance aperture 82 through hole 80 and 88 for egress through exit 84 to the extraction passage 73 to a feed water heater or other external connection. By providing the extraction holes, passages and passageways and locating them in the bottom of the turbine, a significant portion of the solid particles in the steam path can be diverted around the rotating parts of the stages as well as certain of the stationary components, minimizing solid particle erosion of the turbine parts.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A steam turbine comprising:

a stage of the steam turbine including a diaphragm having an inner web, an outer ring and a plurality of stator vanes therebetween;

the outer ring having an axially downstream appendage overlying tips of buckets forming part of the turbine stage;

at least one passage through the appendage for diverting a portion of the steam in a steam flow path upstream of the buckets of the turbine stage and bypassing the buckets of said turbine stage; and a sealing device carried by said appendage for sealing about the bucket tips, and a passage through the sealing device in communication with the passage in the appendage to bypass the diverted portion of the steam about the buckets of said turbine stage.

2. A steam turbine according to claim 1 wherein the sealing device lies intermediate the axial extent of the appendage, the passage through the appendage being divided into two portions on respective opposite sides of the passage through the sealing device.

3. A turbine according to claim 1 wherein the passage through the appendage is located adjacent a bottom of the first stage of the turbine.

4. A steam turbine comprising:

a first stage of the steam turbine including a diaphragm having an inner web, an outer ring and a plurality of stator vanes therebetween;

the outer ring of the first stage having a first axially downstream appendage overlying tips of buckets forming part of the first turbine stage;

at least one passage through the appendage for diverting a portion of the steam in a steam flow path upstream of the buckets of the first turbine stage and bypassing the buckets of said first turbine stage; a second stage of the turbine downstream of the first stage and including a diaphragm having an inner web, an outer ring and a plurality of stator vanes therebetween, said second stage including a passage through the outer ring thereof in communication with the passage through the first stage appendage to flow the diverted steam portion outside of the steam path bypassing the second stage; and wherein said outer ring of said second stage includes a second axially downstream appendage overlying tips of buckets forming part of the second stage, at least one passage through the second stage appendage for diverting a second portion of the steam from the steam path at a location upstream of the stator vanes and buckets of the second stage thereby bypassing the second diverted steam portion about the second stage buckets.

5. A turbine according to claim 4 including an extraction passage for receiving the steam diverted from the steam path and flowing through said second stage passage.

6. A turbine according to claim 4 including a second sealing device carried by the second stage appendage and a passage through the second sealing device in communication with the passage through the second appendage to flow the second diverted portion of the steam to bypass the second stage buckets.

7. A turbine according to claim 4 wherein the second diverted steam portion is extracted from the steam path at a location between said first and second stages.

8. A method of minimizing solid particle erosion in a steam turbine stage comprising diverting a portion of the steam in a steam flow path through a passage in an appendage of an outer ring overlying bucket tips of the turbine stage and bypassing the buckets of the turbine stage; and providing a sealing device carried by said appendage for sealing about the bucket tips, and flowing the diverted portion of the steam through a passage in the sealing device.

9. A method according to claim 8 including locating the passage through the appendage adjacent a bottom of the turbine.

10. A method according to claim 8 including diverting a second portion of the steam in the steam flow path downstream of the first mentioned stage through a passage in an appendage of an outer ring of a second turbine stage overlying bucket tips of the second stage and bypassing the buckets of the second stage.

11. A method according to claim 10 including providing a sealing device carried by said appendage of the second stage for sealing about the bucket tips, and flowing the second diverted portion of the steam through a passage in the sealing device.

12. A turbine according to claim 8 including providing a second turbine stage including an outer ring downstream of the first mentioned stage and a passage in the second outer ring in communication with the passage through the first stage appendage.

* * * * *